US006126262A

United States Patent [19]

Misumi

[11] Patent Number: 6,126,262

[45] Date of Patent: Oct. 3, 2000

[54] INK-JET PRINTING APPARATUS AND INK-JET PRINTING METHOD

[75] Inventor: Yoshinori Misumi, Tokyo, Japan

[73] Assignee: Canon Kabushiki Kaisha, Tokyo, Japan

[21] Appl. No.: 08/824,456

[22] Filed: Mar. 26, 1997

[30] Foreign Application Priority Data

Mar. 28, 1996 [JP] Japan ..... 8-074907

[51] Int. Cl.[7] ..... B41J 2/205

[52] U.S. Cl. ..... 347/15; 347/41

[58] Field of Search ..... 347/15, 41, 57, 347/11, 5

[56] References Cited

U.S. PATENT DOCUMENTS

| | | | |
|---|---|---|---|
| 4,313,124 | 1/1982 | Hara . | |
| 4,345,262 | 8/1982 | Shirato et al. . | |
| 4,459,600 | 7/1984 | Sato et al. . | |
| 4,463,359 | 7/1984 | Ayata et al. . | |
| 4,558,333 | 12/1985 | Sugitani et al. . | |
| 4,608,577 | 8/1986 | Hori . | |
| 4,723,129 | 2/1988 | Endo et al. . | |
| 4,740,796 | 4/1988 | Endo et al. . | |
| 4,963,882 | 10/1990 | Hickman | 346/41 |
| 5,216,445 | 6/1993 | Hiwasawa et al. | 347/40 |
| 5,220,342 | 6/1993 | Moriyama | 347/41 |
| 5,369,428 | 11/1994 | Maze et al. | 347/5 |
| 5,461,403 | 10/1995 | Wallace et al. | 347/10 |
| 5,610,637 | 3/1997 | Sekiya et al. | 347/10 |
| 5,646,663 | 7/1997 | Clark et al. | 347/75 |

FOREIGN PATENT DOCUMENTS

| | | |
|---|---|---|
| 54-056847 | 5/1979 | Japan . |
| 59-123670 | 7/1984 | Japan . |
| 59-138461 | 8/1984 | Japan . |
| 60-071260 | 4/1985 | Japan . |

*Primary Examiner*—John Barlow
*Assistant Examiner*—Michael S. Brooke
*Attorney, Agent, or Firm*—Fitzpatrick, Cella, Harper & Scinto

[57] ABSTRACT

An operation control section forms a command signal Cn so that the number of times ink droplets are ejected per one pixel ejected from each ejection opening of a printing head in accordance with flying characteristics of the ink droplet becomes two times for each pixel in a forward path and once for each pixel in a reverse path. The command signal Cn is fed to a drive pulse signal forming section.

21 Claims, 7 Drawing Sheets

INK-JET PRINTING APPARATUS AND INK-JET PRINTING METHOD

FIELD OF THE INVENTION

The present invention relates to an ink-jet printing apparatus and an ink-jet printing method for performing printing by ejecting an ink droplet from an ink ejecting portion in a printing head. The printing head may be arranged in opposition to a printing surface of a printing medium. The ink droplet is ejected onto the printing surface in accordance with the type of printing data.

DESCRIPTION OF THE RELATED ART

An ink-jet printing apparatus includes a printing head arranged in opposition to a printing surface with paper, cloth or the like as a printing medium, and having a plurality of ink ejecting portions for selectively forming ink droplets from an ink supplied from an ink storage section and ejecting the ink droplet. The apparatus also includes a printing head transporting driving section for reciprocally moving the printing head in a direction substantially perpendicular to a feeding direction of the printing surface, and a drive pulse signal forming section for generating a drive pulse signal on the basis of print control data from a printing signal processing section. The printing signal processing section obtains the printing control data corresponding to the ink ejecting portions of the printing head on the basis of the printing data to be printed on the printing surface. The drive pulse signal forming section also supplies the drive pulse signal for respective ink ejecting portions.

With the construction set forth above, when the printing surface in the printing medium is placed in opposition to the ink ejecting portions of the printing head and intermittently fed, the printing -head is moved reciprocally, for example in a direction substantially perpendicular to the feeding direction of the printing surface of the printing medium by the printing head transportation driving section. Then, respective ink ejecting portions aligned in the feeding direction of the printing medium eject the ink droplets toward the printing surface through ink ejection openings according to the drive pulse signal from the drive pulse signal forming section. By this, image characters and the like are printed on the printing surface on the basis of the printing data.

When the printing head performs a printing operation with reciprocal movement, for example, in the direction perpendicular to the feeding direction of the printing surface of the printing medium, the ink droplet ejected from each ejection opening of an ink ejecting portion 74 in the printing head 72 consists of main droplet 78*i* (I=1 to n) reaching a printing surface 76*a* of a paper 76 as the printing medium, makes up a prime portion of one pixel formed image or character, and a satellite droplet or sub-droplet 78*ai* (I=1 to n) formed by scattering of the remaining part of the ejected main droplet 78I or a part of the ink liquid deposited on the periphery of the ink ejection opening in one direction, as shown in FIG. 7A. In FIG. 7A, the respective one main droplet and satellite droplet are representationally shown. The satellite droplet 78*ai* scatters in one direction depending upon an ink droplet scattering characteristics e.g. characteristics of the printing head (shape of the ink ejection opening, property of the ink liquid).

When the printing head 72 is driven to move in a direction of arrow F in FIG. 7A, namely along a forward path, and if a relative flying direction of the satellite droplet 78*ai* with respect to the main droplet 78*i* is opposite to the direction represented by the arrow F in FIG. 7 and is in a direction away from the main droplet, the position where the main droplet 78*i* hits the printing surface 76*a* is deflected from the position where the satellite droplet 78*ai* hits the printing surface 76*a* in the moving direction of the printing head, as shown in FIG. 7B. In this situation, a portion 82*ai* of a printed image formed by the satellite droplet 78*ai* may be formed to be overlapped and included in a portion 80*i* formed as one pixel by the main droplet 78*i* hitting the printing surface 76*a*.

On the other hand, when the printing head 72 is driven to move in the reverse direction as shown by arrow R in FIG. 7A, namely along a return path, the position where the main droplet 78*i* hits the printing surface 76*a* is deflected from the position where the satellite droplet 78*ai* hits the printing surface 76*a* in the opposite direction to the moving direction of the printing head 72 as shown in FIG. 7*c*. Therefore, the portion 82*ai* of the printed image formed by the satellite droplet 78*ai* is located adjacent the boundary of the portion 80*i* of the printed image formed on the printing surface 76*a* by the main droplet 78*i,* at the side of the of movement. Thus, a portion 80*pi* having area including the area of the portion 80*i* and the area of the portion 82*ai* is formed as one pixel.

When the area of one pixel formed on the printing surface 76*a* while the printing head 72 is moved along the forward path and the area of one pixel formed on the printing surface 76*a* while the printing head 72 is moved along the return path are different, densities of graphic image or character formed on the printing surface may be differentiated between forward and reverse scan.

SUMMARY OF THE INVENTION

In view of the problem set forth above, it is an object of the present invention to provide an ink-jet printing apparatus and an ink-jet printing method for performing printing by ejecting an ink droplet from an ink ejecting portion, in a printing head arranged so as to oppose a printing surface in a printing medium, onto the printing surface in accordance with printing data. By using the printing data, the apparatus or method can make an area of one pixel formed on the printing surface during motion of the printing head in one direction equal to an area of one pixel formed on the printing surface during motion of the printing head in the other direction, and can make printing densities in the forward path and the return path uniform.

In a first aspect of the present invention, there is provided an ink-jet printing apparatus employing a printing head arranged so as to oppose a printing surface in a printing medium and having an ink ejecting portion ejecting an ink droplet group including individual ink droplets supplied from an ink storage section in a manner that depends upon a printing data, comprising:

control portion controlling a depositing area per one pixel formed by ink droplets reaching the printing surface of the printing medium by varying the number of times ink droplets are ejected from ink ejecting portions of the printing head, which reciprocates substantially in parallel to the printing surface in the printing medium, at least one in a forward direction and at least once in a reverse.

In a second aspect of the present invention, there is provided an ink-jet printing apparatus comprising:

a printing head transporting drive section for moving a printing head, which is arranged opposing a printing surface of a printing medium and includes an ink ejecting portion for ejecting ink droplets supplied from an ink storage section in a manner depending upon printing data, toward the printing surface, the printing head transporting drive section reciprocally driving the ink ejecting portion substantially in parallel to the printing surface of the printing medium;

a moving direction detecting section for detecting moving direction of the printing head driven by the printing head transporting drive section and feeding a detection output;

a drive pulse signal forming section forming a drive pulse control signal on the basis of printing control data from a printing signal processing section and supplying the drive pulse control signal to the ink ejecting portion in the printing head in order to selectively drive the ink ejecting portion in the printing head; and an operation control section for operating the drive pulse signal forming section for making a depositing area per each pixel formed by an ink droplet reaching the printing surface of the printing medium in reciprocal motion of the printing head uniform on the basis of the moving direction of the printing head represented by the detection output from the moving direction detecting section and predetermined flying characteristics of ink droplets from the ink ejecting portion of the printing head.

As can be clear from the description set forth above, the ink-jet printing apparatus and the ink-jet printing method according the present invention is operated by the control portion so that the depositing area each pixel formed by the ink droplet reaching the printing surface of the printing medium becomes uniform each other pixel formed in a reciprocal motion of the printing head. Thus, the area of one pixel formed on the printing surface while the printing head is moved in one direction and the area of the one pixel formed on the printing surface while the printing head is moved in the other direction is made uniform. Thus, printing density in the forward path and the reverse path can be held uniform.

Accordingly, when the density of the pixel in the printing data is varied along the transporting direction of the printing head in a checkered image (half-tone image), no unwanted strip pattern is formed on the printing surface.

The above and other objects, effects, features and advantages of the present invention will become more apparent from the following description of embodiments thereof taken in conjunction with the accompanying drawings

BRIEF DESCRIPTION OF THE DRAWINGS

The present invention will be understood more fully from the detailed description given herebelow and from the accompanying drawings of the preferred embodiment of the invention, which, however, should not be taken to be limitative to the present invention, but are provided for explanation and understanding only.

In the drawings.

DESCRIPTION OF THE PREFERRED EMBODIMENT

The present invention will be discussed hereinafter in detail in terms of the preferred embodiment of the present invention with reference to the accompanying drawings. In the following description, numerous specific details are set forth in order to provide a thorough understanding of the present invention. It will be obvious, however, to those skilled in the art that the present invention may be practiced without these specific details. In other instances, well-known structures are not shown in detail in order to avoid unnecessarily obscuring the features of the present invention.

Figure 2:
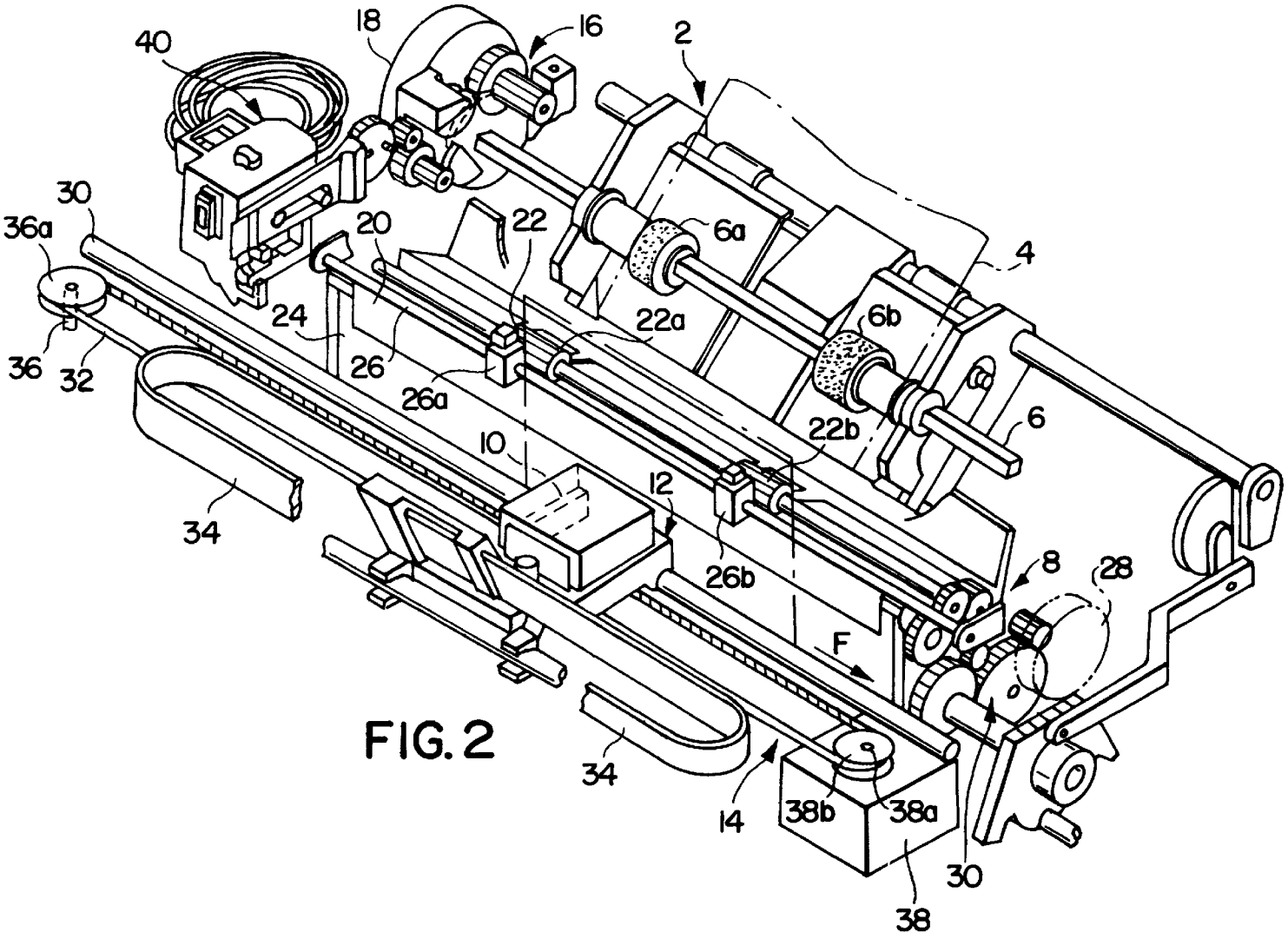
FIG. 2 is a perspective view showing the major portion of one embodiment of the ink-jet printing apparatus according to the present invention.

The general construction of the major part of one embodiment of an ink-jet printing apparatus according to the present invention is illustrated in FIG. 2.

In FIG. 2, the shown embodiment of the ink-jet printing apparatus includes a paper feeding tray portion 2 provided with a paper feeding rotary shaft 6 having paper feeding rollers 6*a* and 6*b* for feeding a printing paper 4 as a printing medium. A transporting section 8 transports the printing paper 4 from the paper feeding tray 2. A printing portion 12 having a printing head 10 performs printing operation on the printing paper 4 fed from the transporting section 8, and a transporting driving section 14 reciprocally moves the printing portion 12 in a direction perpendicular to the transporting direction of the printing paper 4

One end of the paper feeding rotary shaft 6 in the paper feeding tray portion 2 is connected to a paper feeding drive motor 18 via a gear mechanism 16. The paper feeding drive motor 18 is controlled by a drive control signal from a drive control portion (not shown). When the drive control signal is supplied to the paper feeding drive motor 18 to rotate the paper feeding rotary shaft 6, the printing paper supplied from the paper feeding tray portion 2 is fed into the transporting section 8 by a frictional force between the surface thereof and the paper feeding rollers 6*a* and 6*b*.

The transporting section 8 includes a paper feeding roller unit 20 transporting the printing paper 4 from the paper feeding tray portion 2, a plate form platen member 24 arranged opposing to the paper feeding roller unit 20 and restricting the printing surface of the transported printing paper 4 in flat condition. The transporting section 8 also includes a paper eject rotary shaft 22 having paper eject rollers 22*a* and 22*b* for ejecting the printing paper 4 fed out by the paper feeding roller unit 20 and, a paper restricting member 26 arranged so as to oppose the paper eject rotary shaft 22 and having sliding contact members 26*a* and 26*b* cooperated with the paper eject rollers 22*a* and 22*b* for ejecting the printing paper 4.

The paper feeding roller unit 20 is arranged so as to be substantially parallel with the paper feeding rotary shaft 6. Both ends of the paper feeding roller unit 20 are supported rotatably. One end of the paper feeding roller unit 20 is connected to an output shaft of a driving motor 28 via a gear mechanism portion 30.

The lower portion of the printing portion 12 is guided by a guide shaft 30 arranged opposing to the former in a parallel relationship, along the axis of the paper feeding roller unit 20 and is connected to a transporting belt 32. A wiring portion 34 of a printing circuit board which feeds a drive pulse control signal from a control block portion is connected to the printing portion 12, as will be seen later. The transporting belt 32 is stretched between a pulley 36*a* fixed onto the rotary shaft 36 and a pulley 38*b* fixed on an output shaft 38*a* of the drive motor 38. The drive motor 38 is controlled by a drive control signal from the control block portion which will be described later, that controls the alternating repetition of forward and reverse revolution. When the drive motor 38 is actuated in response to the drive control signal from the control block portion to cause revolution in the forward direction, the printing portion 12 is guided by the guide shaft 30 to move perpendicularly to the transporting direction of the printing paper 4 in the direction shown by the arrow F of FIG. 2. On the other hand, when the drive motor 38 is actuated to cause revolution in the reverse direction, the printing portion 12 is guided by the guide shaft to move perpendicularly to the transporting direction of the printing paper 4 in the opposite direction shown by the arrow F of FIG. 2. Between the paper feeding drive motor 18 and one end of the guide shaft 30, a suction recovery processing unit 40 is arranged to perform a suction recovery process for the printing head 10.

The printing portion 12 is a cartridge in which the printing head 10 and an ink tank portion are integrated, for example.. The printing head 10 is an ink bubble-jet head portion, for example, which includes a substrate 42 formed of silicon (Si), glass, ceramic or the like. The printing head is provided with an electrode array portion 44, an ink passage forming portion 46 formed with a plurality of grooves as ink passages provided corresponding to respective heating resistors in the electrode array portion 44, and an upper plate portion 48 formed with an ink liquid chamber 50 formed in the backside of the ink passage forming portion 46 and supplying an ink liquid to respective ink passages in the ink passage forming portion 46, as shown in FIG. 3B.

Figure 3A:
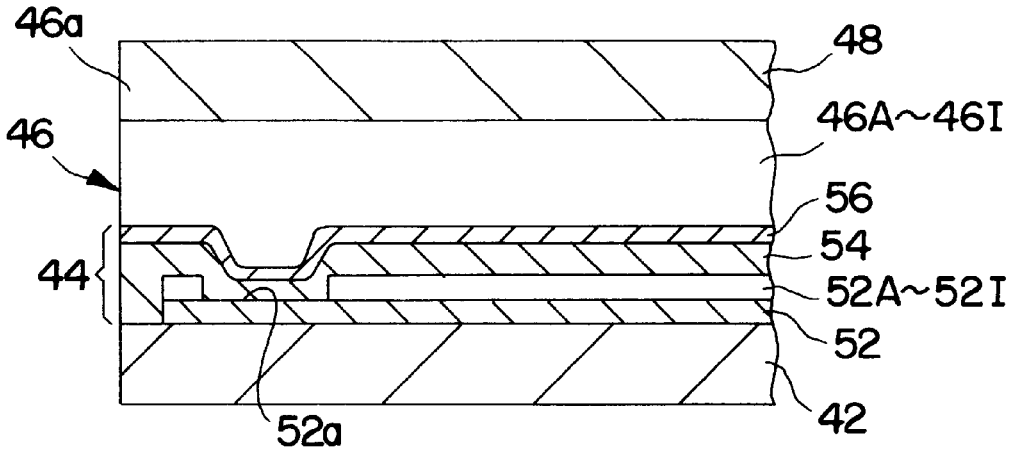
FIG. 3A is a partial section showing the major part of a printing head employed in one embodiment of the ink-jet printing apparatus according to the present invention.
Figure 3B:
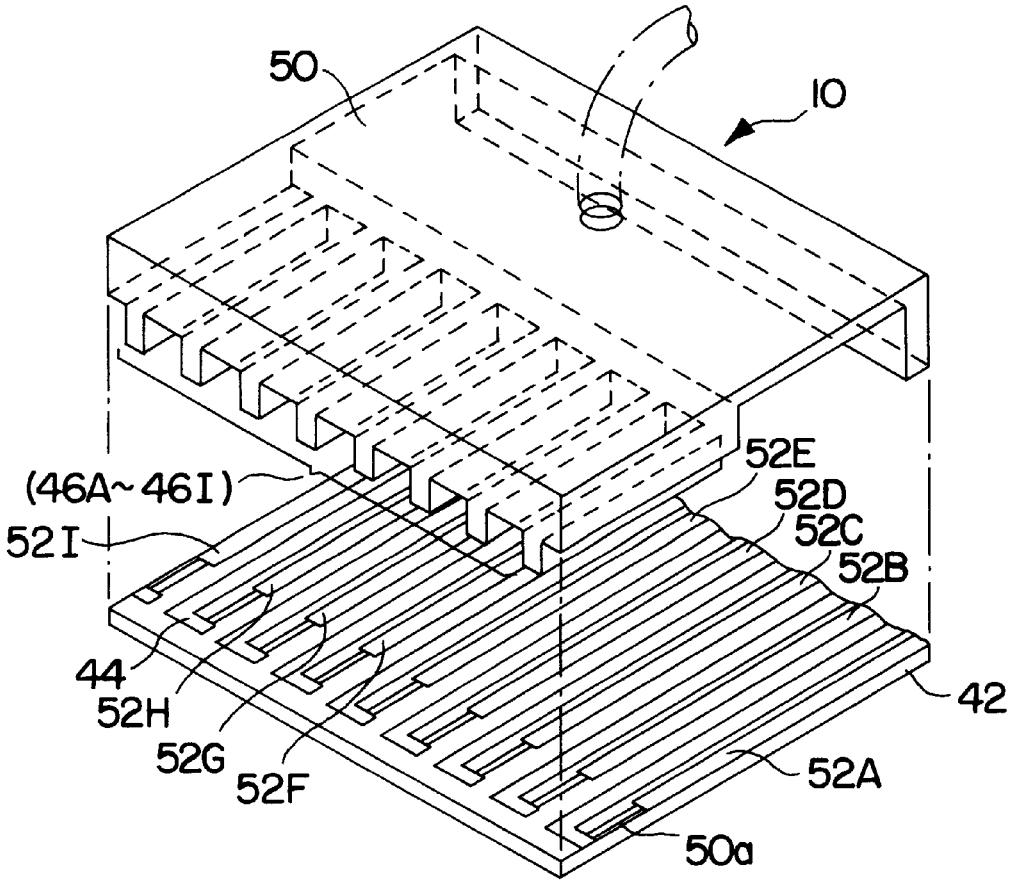
FIG. 3B is a perspective view showing the major part of the printing head employed in one embodiment of the ink-jet printing apparatus according to the present invention.

As shown in FIGS. 3A and 3B, the electrode array portion 44 is constructed with respective electrode portions 52A to 52I arranged on a plurality of heating resistors 52, an antioxidation layer 54 covering respective electrode portions 52A to 52I, and an anti-cavitation protecting layer 56 covering the antioxidation layer 54. On a plurality of heating resistors 52, heaters 52*a* to 52*i* as heating portions connecting between the electrodes are provided. Each heater 52*a* to 52*i* generates heat in response to the drive pulse control signal supplied to the electrode portion.

The ink passage forming portion 46 is provided with ink passages 46A to 46I respectively having ejection openings 46*a* to 46*i* for ejecting ink droplets at positions above the anti-cavitation protecting layer 56, corresponding to respective heaters 52*a* to 52*i*. Respective ink passages 46A to 46I are commonly connected to the ink liquid chamber 50. In the ink liquid chamber 50, the ink liquid is sequentially supplied from not shown ink tank portion through a supply passage 50A. While the ink liquid is supplied through the ink passages 46A to 46I, when the heaters 52*a* to 52*i* are heated respectively, the ink liquid located at the heaters 52*a* to 52*i* in the ink passages 46A to 46I is ejected by film boiling to generating bubble therein. The ink droplets separated in respective ejection openings 46*a* to 46*i* and formed into the droplets, are ejected toward the printing paper 4. In respective ejection openings 46*a* to 46*i*, through which the ink droplets were ejected, spherical surfaces formed on the end surfaces of the ink droplets (hereinafter referred to as meniscus) are retracted and the ink liquid is supplied into the ink passages 46A to 46I from the ink liquid chamber 50 by capillary force to extinguish bubbles.

Figure 4A:
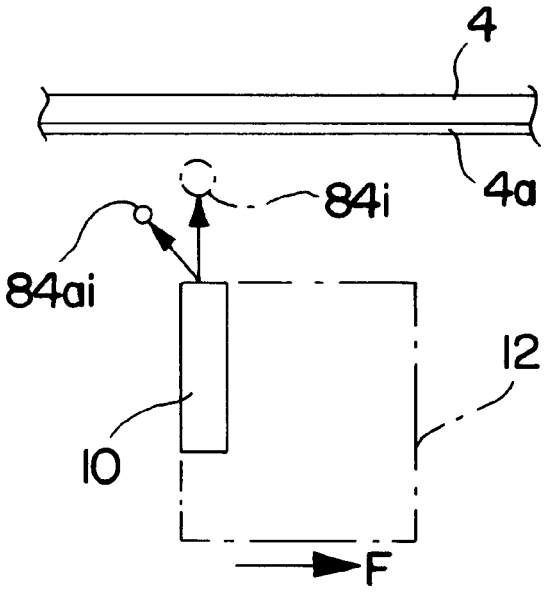
FIG. 4A is an illustration representing the discharge of ink droplets in the embodiment shown in FIG. 1.

Each ink droplet ejected from the ejection openings 46*a* to 46*i* in the printing head 10 consists of a main droplet 84*i* ejected in a direction nearly perpendicular to the feeding direction shown in the arrow F of FIG. 2 and in the arrow F of FIG. 4, and a satellite droplet 84*ai*. The satellite droplet 84*ai* flies in a direction opposite to the direction of arrow F, at a predetermined angle, e.g. 5 degree, with respect to ejecting direction of the main droplet 84*i*. This travel pattern of droplets occurs in the condition where the printing head 10 is located opposing the printing surface 4*a* of the printing paper 4 with a predetermined distance, e.g. 1.5 mm, as shown in FIG. 4A. It has been preliminarily confirmed through experiments of the inventors that respective ejection speeds of the main droplet and the satellite droplet are 12 m/s and 6 m/s. FIG. 4A illustrates main droplet 84*i* and satellite droplet 84*ai* ejected from one ejection opening, as representative.

Figure 1:
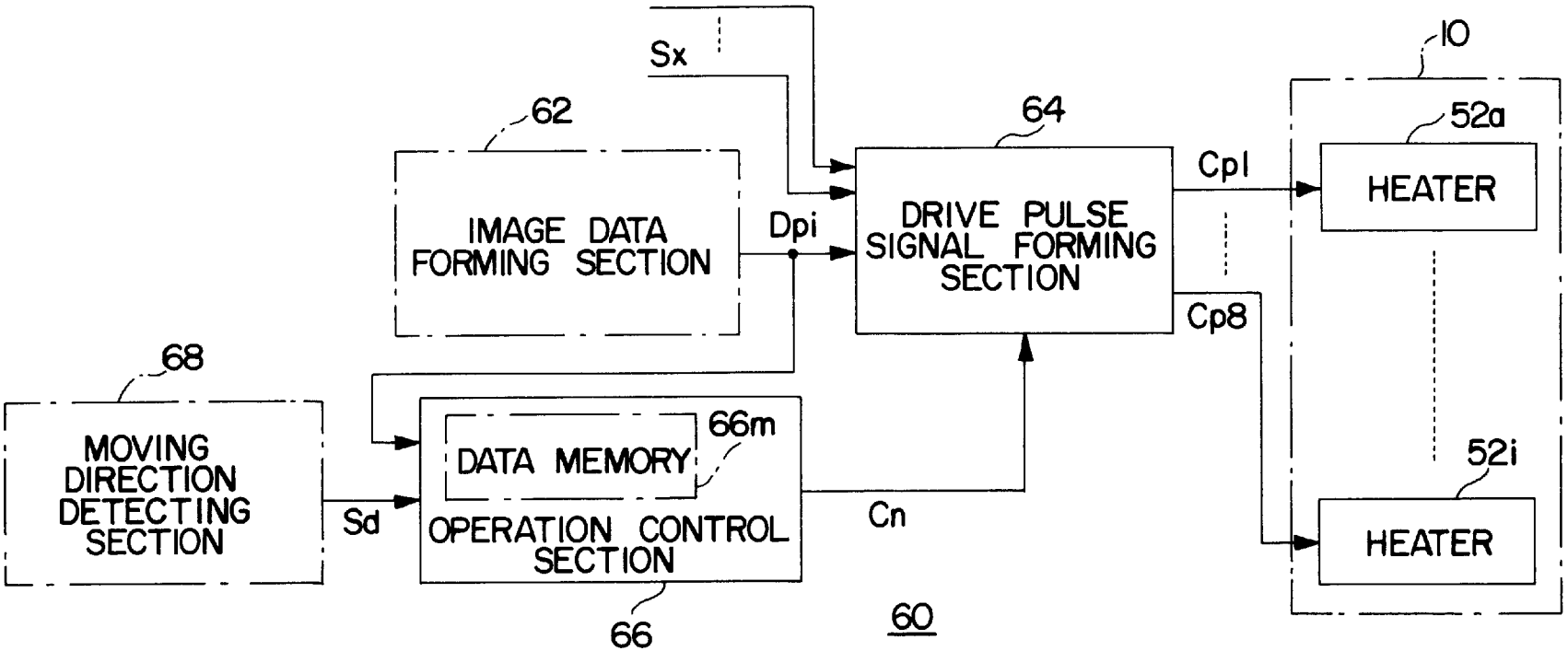
FIG. 1 is a block diagram showing a control block portion included in one embodiment of an ink-jet printing apparatus according to the present invention.

In addition, the ink-jet printing apparatus according to the present invention is provided with a control block portion 60 that controls the driving of the transporting drive portion 14 and the printing head 10, as shown in FIG. 1.

The control block portion 60 is constructed with a drive pulse signal forming section 64 supplying drive control pulse signals Cp1 to Cp8 to respective electrode portions 52A to 52I (heaters 52*a* to 52*i*) in the printing head 10 of the printing portion 12, and an operation control section 66 for controlling operation of the drive pulse signal forming section 64 on the basis of detection output signal Sd from a moving direction detecting section 68 detecting the moving direction of the printing portion 12.

When the printing portion 12 is moved in the direction shown by arrow F of FIG. 2, namely when the printing portion 12 starts moving or is moving in the forward path, the moving direction detecting section 68 supplies the detection output signal Sd indicative thereof to the motion control section 66. Also, when the printing portion 12 is moved in the opposite direction to the direction shown by arrow F of FIG. 2, namely when the printing portion 12 starts moving or is moving in the reverse path, the moving direction detecting section 68 supplies the detection output signal Sd indicative thereof to the motion control section 66.

The operation control section 66, to which the detection output signal Sd is supplied, has connected to it an image data forming section 62 as a printing signal processing section. The image data forming section 62 forms a binary data through predetermined signal processing of the image data to be printed on the printing paper 4, and feeds printing data group Dpi corresponding to respective electrode portions 52A to 52I (heaters 52*a* to 52*i*) in the printing head 10 in the printing portion 12. By this, the printing data group Dpi is supplied to the operation control section 66 from the image data forming section 62.

The operation control section 66 includes a data memory portion 66*m* which stores the printing data group Dpi per each one line to be printed on the printing surface 4*a* at a predetermined timing, and reads them out. The operation control section 66 forms a command signal Cn for controlling the number of times ink droplets are to be ejected from respective ejection openings 46*a* to 46*i* of the printing head 10 per one pixel, on the basis of the detection output signal Sd, and supplies the command signal Cn to the drive pulse signal forming section 64. The operation control section 66 reads out the printing data group Dpi stored in the data memory portion 66*m,* makes a judgment whether the printing data is data representative of a checkered form image (half-tone image) or not, forms the command signal Cn for controlling the number of times ink droplets are to be ejected from respective ejection openings 46*a* to 46*i* of the printing head 10 per one pixel, even when the printing data is a data representative of checkered image (half-tone image), and supplies the command signal Cn to the drive pulse signal forming section 64.

Further, the operation control section 66 reads out the printing data group Dpi stored in the data memory portion 66*m* in the preceding cycle and the currently stored printing data group Dpi, compares both sets of data per each ejection openings 46*a* to 46*i* of the printing head 10, and makes a judgment whether the printing data is continuous data or non-continuos data along the moving direction of the printing head 10. The operation control section 66 forms the command signal Cn for controlling number of times ink droplets are to be ejected from respective ejection openings 46*a* to 46*i* of the printing head 10 per one pixel on the basis of the judgment, and supplies the command signal Cn to the drive pulse signal forming section 64.

To the drive pulse signal forming section 64, the command signal Cn from the operation control section 66, the printing data group Dpi from the image data forming section 62, a control signal group Sx including an enabling signal from a central arithmetic processing unit (not shown) and a clock timing signal are supplied.

When the operation control section 66 is supplied, the detection output signal Sd representative of the starting of moving or being in motion in the forward path of the printing portion 12, the command signal Cn representative of twice of the ejection of the ink droplets per one pixel from the operation control section 66 is supplied to the drive pulse signal forming section 64.

Figure 5A:
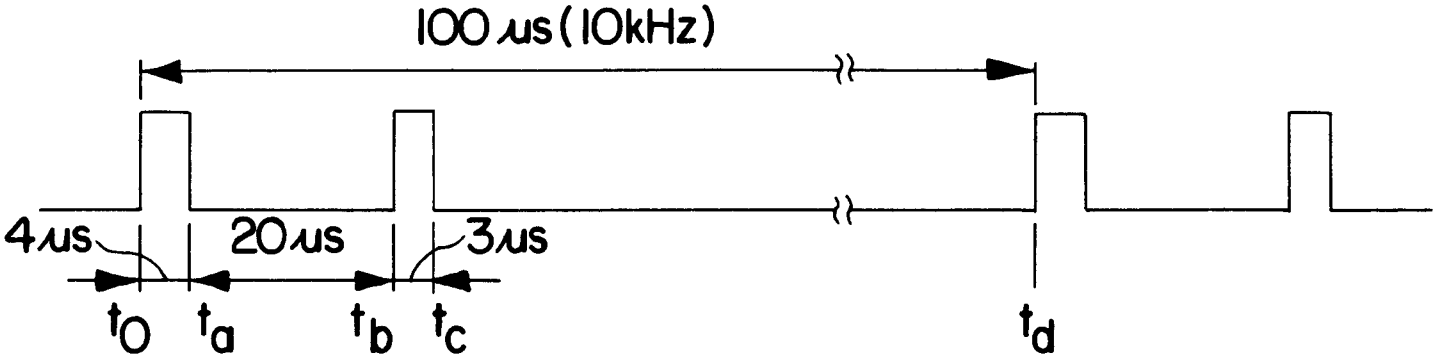
FIG. 5A is a chart showing a pulse waveform for explaining the operation of the embodiment shown in FIG. 1.
Figure 5B:
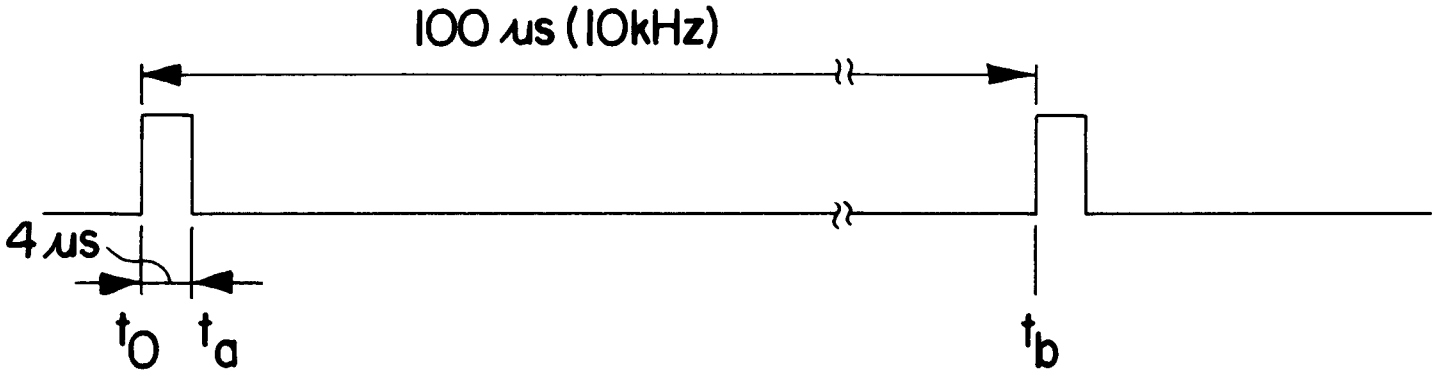
FIG. 5B is a chart showing a pulse waveform for explaining the operation of the embodiment shown in FIG. 1.

The drive pulse signal forming section 64 forms the drive pulse signals Cp1 to Cp8 shown in FIG. 5A on the basis of the printing data group Dpi and the control signal group Sx, and supplies them to the heaters 52*a* to 52*i* via respective electrode portions in the printing head 10, respectively.

The drive pulse signal Cp1 has an ejection frequency of 10 kHz and maintain high level for a predetermined period, e.g. 4 $\mu$s, from a timing $t_0$, at which the ink liquid is filled within the ink passage 46A and subsequently takes a low level for a predetermined period, e.g. 20 $\mu$s from a timing $t_a$, at which the predetermined period from the timing $t_0$ expires, to a timing $t_b$. Then, for a predetermined period, e.g. 3 $\mu$s, from the timing $t_b$ to a timing $t_c$, the drive pulse signal Cp1 becomes a high level. Thereafter, the drive pulse signal Cp1 becomes a low level up to the end of one cycle.

The period between the timing $t_a$ to the timing $t_b$, is set at a short period from the completion of the ejection of the first ink droplet (main droplet and satellite droplet) to the retracting of the meniscus up to the position in the vicinity of the ejection opening 46*a*. Ink droplets are ejected twice from ejection opening 46*a*. The size of the second ink droplet becomes smaller than the size of the first ink droplet (main droplet and satellite droplet). This is because the ejection of the second ink droplet is performed with an interval shorter than a re-fill period required for sufficiently re-filling ink to the ink passage after ejection of the first ink droplet.

Figure 4B:
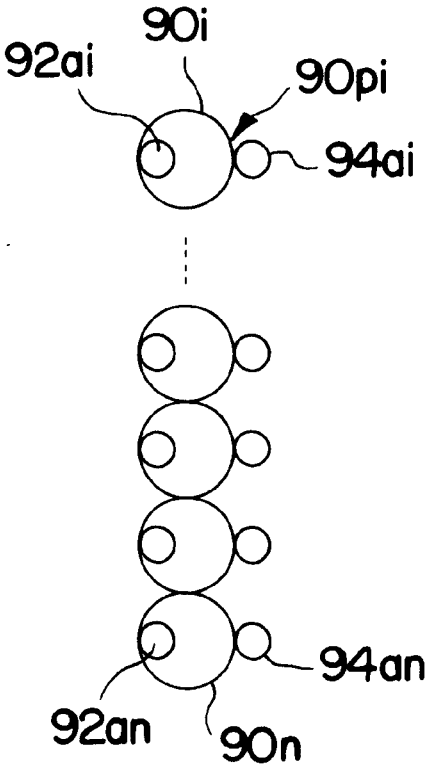
FIG. 4B is an illustration representing the depositing areas of ink droplets

Thus, when the ink droplets are ejected twice, the position where a main droplet 84*i* (i=1 to n, n=8) of the first ink droplet hits the printing surface 4*a* is deflected from the position where the satellite droplet 84*ai* (i=1 to n, n=8) hits and deposits the printing surface 4*a* in the moving direction of the printing head 10. Thus, a portion 92*ai* of a printed image formed by the satellite droplet 84*ai* overlaps and is included in a portion 90*i* of the printed image formed by the main droplet 84*i,* as shown in FIG. 4B. Then, a portion 94*ai* of the image formed by hitting of the second ink droplet onto the printing surface 4*a* is formed adjacent the portion 90*i* formed by the main droplet 84*i*. Thus, a portion 90*pi* having an area including the area of the portion 90*i* and the area of the portion 94*ai* is formed as one pixel.

On the other hand, when the operation control section 66 is supplied the detection output signal Sd representative of the starting of moving or being in movement in the return path of the printing portion 12, the command signal Cn representative of one time of the ejection of the ink droplets per one pixel from the operation control section 66 is supplied to the drive pulse signal forming section 64.

The drive pulse signal forming section 64 forms the drive pulse signals Cp1 to Cp8 shown in FIGS. 5A on the basis of the printing data group Dpi and the control signal group Sx, and supplies to the heaters 52*a* to 52*i* via respective electrode portion in the printing head 10, respectively.

The drive pulse signal Cp1 has an ejection frequency of 10 kHz and maintain a high level for a predetermined period, e.g. 4 $\mu$s, from a timing $t_0$, at which the ink liquid is filled within the ink passage 46A and subsequently takes a low level for a period from the timing ta, at which the period from the timing $t_0$ expires, up to a timing tb, at which one cycle conclude. By this, the ink droplet (main droplet and satellite droplet) is ejected once.

Figure 4C:
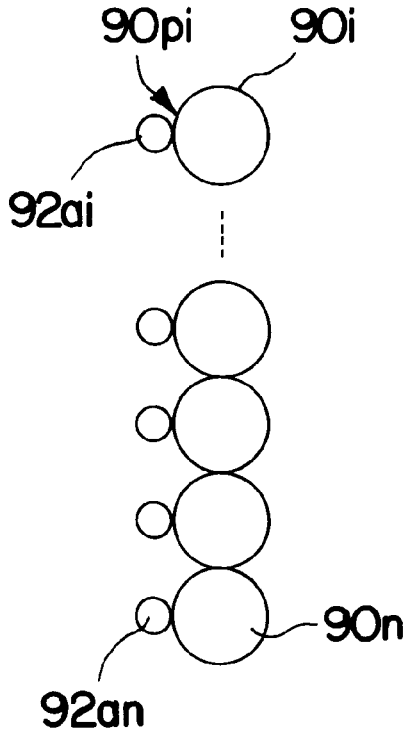
FIG. 4C is an illustration representing the depositing area of ink droplets.

When the ink droplet is ejected once from the ejection opening 46*a,* the position where the main droplet 84*i* hits the printing surface 4*a* is deflected from the position where the satellite droplet 84*ai* hits the printing surface 4*a* in a direction opposite to the moving direction of the printing head 10 as shown in FIG. 4*c*. By this, the portion 92*ai* of the printed image formed by the satellite droplet 84*ai* is located adjacent the boundary of the portion 90*i* of the printed image formed on the printing surface 4*a* by the main droplet 84*i,* at the side in the direction of motion. Thus, a portion 90*pi* having area including the area of the portion 90*i* and the area of the portion 92*ai* is formed as one pixel.

Accordingly, when the printing operation is performed for the printing surface 4*a* of the printing paper 4 by reciprocal movement of the printing heat portion, the area of one pixel formed on the printing surface while the printing head 10 is transported along the forward path and the area of one pixel formed on the printing surface while the printing head 10 is transported along the return path become equal to each other. Thus, printing densities in forward path and the return path become uniform.

The operation control section 66 reads out the printing data group Dpi stored in the data memory portion 66*m* and makes judgment whether the printing data is the data representative of the checkered image (half-tone image) or not on the basis thereof. Even when judgment is made that the printing data is the data representative of the checkered image (half-tone image), the operation control section 66 supplies the command signal Cn indicative of two ejections in the forward path and one ejection in the return path, to the drive pulse signal forming section 64. At this time, judgment whether the printing data is the data representative of the checkered image (half-tone image) or not in the operation control section 66 calculates the amount of data (1 or 0) corresponding to respective ejection openings 46*a* to 46*i* of the printing head 10 per read out printing data of one line with respect to predetermined unit image data, and makes a judgment that the data represents of the checkered image (half-tone image) when a counted value is less than 50%. By this process, in the checkered form image printed on the printing surface 4*a* of the printing paper 4, it becomes possible to avoid forming an unwanted stripe pattern Even when the detection output signal Sd, indicating that the printing portion 12 is starting movement or is moving in the forward path, is supplied to the operation control section 66, and when the operation control section 66 reads out that the printing data group DPi stored in the preceding cycle in the data memory portion 66*m* and the printing data group DPi currently stored and compares the data of each ejection opening 46*a* to 46*i* of the printing head 10. When the printing data is not continuous along the moving direction of the printing head 10, the operation control section 66 supplies the command signal Cn indicating two ejections per one pixel, to the drive pulse signal forming section 64.

On the one hand, when the detection output signal Sd indicating that the printing portion 12 is starting movement or is moving in the return path, is supplied to the operation control section 66, the operation control section 66 supplies the command signal Cn indicating one time ejection of ink droplet per one pixel to the drive pulse signal forming section 64.

Figure 6A:
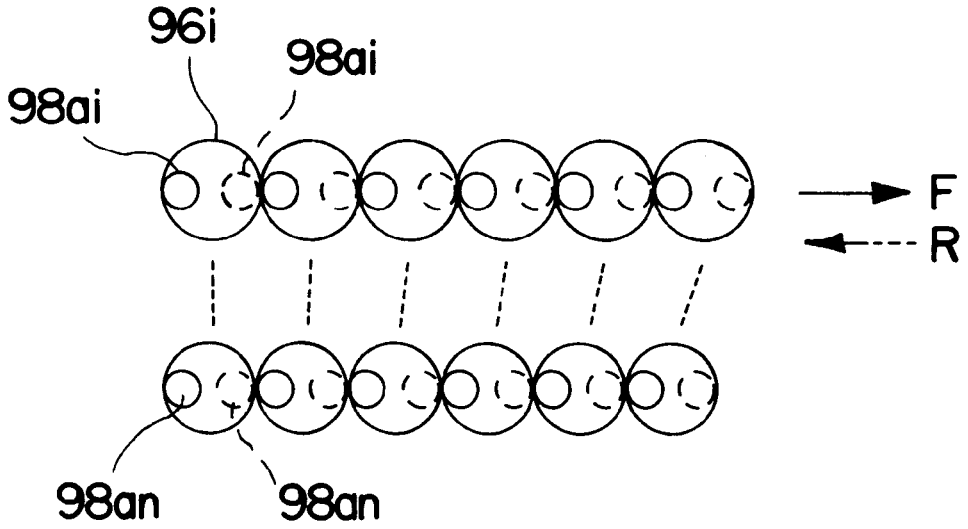
FIG. 6A is an illustration for explaining the operation of the embodiment shown in FIG. 1.
Figure 6B:
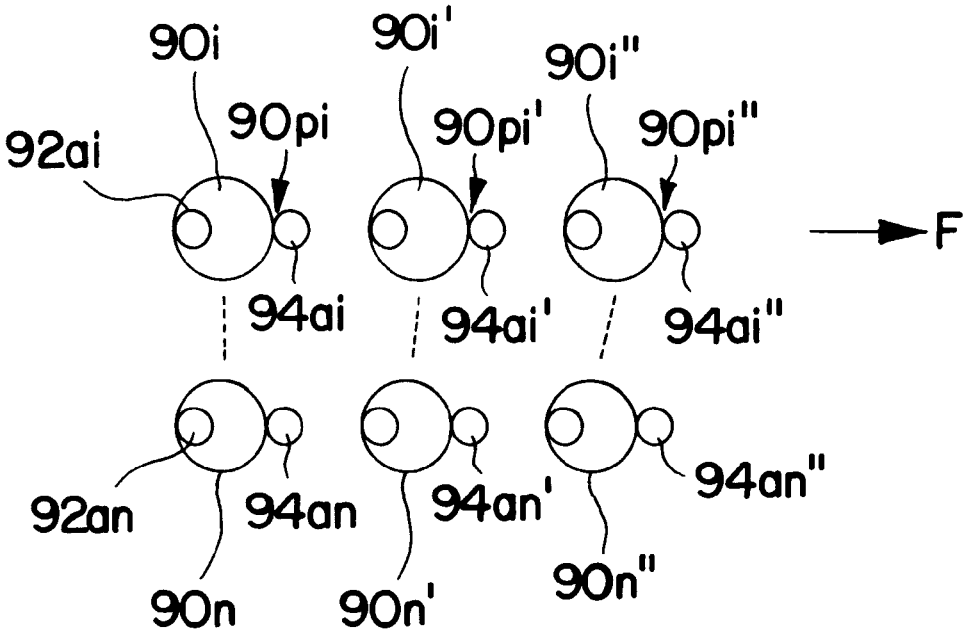
FIG. 6B is an illustration for explaining the operation of the embodiment shown in FIG. 1.
Figure 7A:
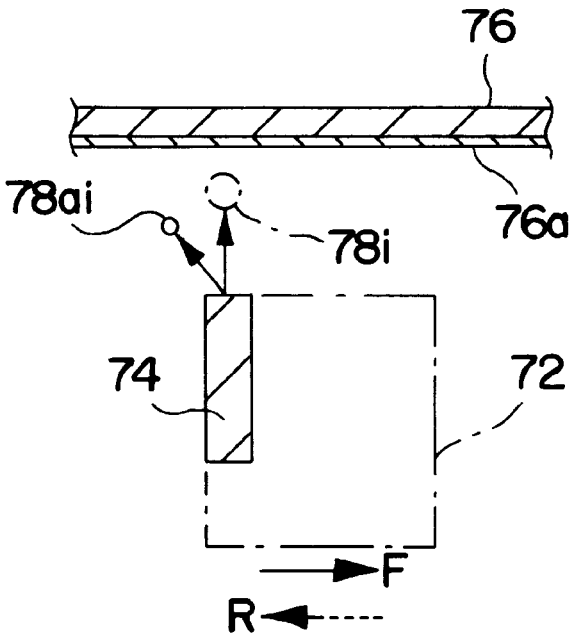
FIG. 7A is an illustration for explaining the operation of the conventional apparatus.
Figure 7B:
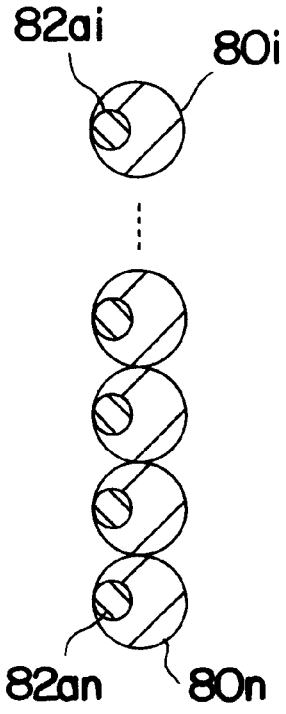
FIG. 7B is an illustration for explaining the operation of the conventional apparatus.
Figure 7C:
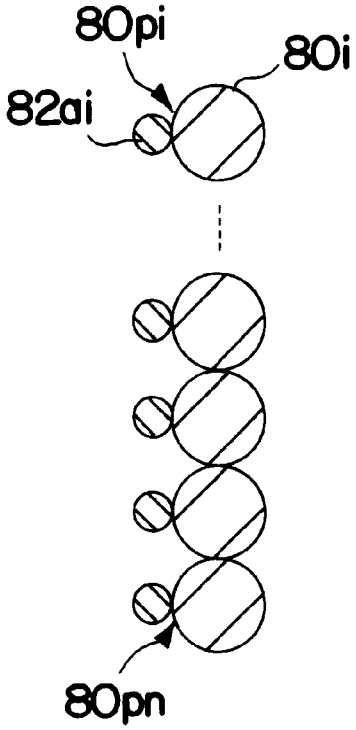
FIG. 7C is an illustration for explaining the operation of the conventional apparatus.

By this, similarly to the examples shown in FIG. 4B, as shown in FIG. 6B, on the printing surface 4*a* of the printing paper 4, along the transporting direction shown by the arrow F, per sequentially supplied the printing data, the portion 94*ai* of the printed image formed by the second ink droplet on the printing surface 4*a* is formed adjacent the portion 90*i* formed by the first main droplet 84*i* at the side of the moving direction. Namely, the portion 90*pi* having the area in which the area of the printing portion 90*i* and the area of the portion 94*ai* are summed, the portion 90*pi*' having the area in which the area of the printing portion 90*i*' and the area of the portion 94*ai*' are summed, and the portion 90*pi*" having the area in which the area of the printing portion 90*i*" and the area of the portion 94*ai*" are summed, are formed sequentially as respective one pixels depending upon sequentially supplied printing data. In the return path, similarly to the example shown in FIG. 4C, per group of sequentially supplied printing data, respective one pixels are formed.

When the operation control section 66 makes a judgment of whether the printing data is continuous or non-continuous, among the printing data consisting of a predetermined number of bits, supplied corresponding to ejection opening 46*a* of printing head 10, if the data is the preceding cycle is 1 and the data in the current cycle is 0, the operation control section 66 judges that the data is non-continuos. On the other hand, if the data in the preceding cycle is 1 and the data in the current cycle is 1 the operation control section 66 judges that the data is continues.

When the operation control section 66 makes a judgment that the printing data is continuous data along the moving direction of the printing head 10, the operation control section 66 supplies the command signal Cn, indicating that the number of ejections of ink droplets per one pixel is one, to the drive pulse signal forming section 64.

By this, as shown in FIG. 6A, on the printing surface 4*a* of the printing paper 4, in the transporting direction of the arrow F, namely in the forward path, respective one pixels, in which the portion 98*ai* of the printed image formed by the satellite droplet 84*ai* is formed overlapping with the portion 96*i* of printed image formed by the main droplet 84*i*, are formed continuously. In the transporting direction of the arrow R, namely in the return path, there is a continuous formation of respective one pixels, in which the portion 98*ai* (shown by broken line) of the printed image formed by the satellite droplet 84*ai* is formed adjacent the portion 96*i* of the printed image formed by the main droplet 84*i* at side of motion direction and overlapping with the portion 96*i* formed with next main droplet 84*i*.

When the printing operation is performed with respect to the printing surface 4*a* of the printing paper 4 with by reciprocally moving the printing heat portion 10, the area of one pixel formed on the printing surface while the printing head 10 is transported along the forward path and the area of one pixel formed on the printing surface while the printing head 10 is transported along the return path become equal to each other. Thus, printing densities in forward path and the return path become uniform.

The present invention has been described in detail with respect to preferred embodiments, and it will now be apparent from the foregoing to those skilled in the art that changes and modifications may be made without departing from the invention in its broader aspects, and it is the intention, therefore, in the appended claims to cover all such changes and modifications as fall within the true spirit of the invention.

The present invention achieves distinct effect when applied to a recording head or a recording apparatus which has means for generating thermal energy such as electrothermal transducers or laser light, and which causes changes in ink by the thermal energy so as to eject ink. This is because such a system can achieve a high density and high resolution recording.

A typical structure and operational principle thereof is disclosed in U.S. Pat. Nos. 4,723,129 and 4,740,796, and it is preferable to use this basic principle to implement such a system. Although this system can be applied either to on-demand type or continuous type ink jet recording systems, it is particularly suitable for the on-demand type apparatus. This is because the on-demand type apparatus has electrothermal transducers, each disposed on a sheet or liquid passage that retains liquid (ink), and operates as follows: first, one or more drive signals are applied to the electrothermal transducers to cause thermal energy corresponding to recording information; second, the thermal energy induces a sudden temperature rise that exceeds the nucleate boiling so as to cause film boiling on heating portions of the recording head; and third, bubbles are grown in the liquid (ink) corresponding to the drive signals. By using the growth and collapse of the bubbles, the ink is expelled from at least one of the ink ejection orifices of the head to form one or more ink drops. The drive signal in the form of a pulse is preferable because the growth and collapse of the bubbles can be achieved instantaneously and suitably by this form of drive signal. As a drive signal in the form of a pulse, those described in U.S. Pat. Nos. 4,463,359 and 4,345,262 are preferable. In addition, it is preferable that the rate of temperature rise of the heating portions described in U.S. Pat. No. 4,313,124 be adopted to achieve better recording.

U.S. Pat. Nos. 4,558,333 and 4,459,600 disclose the following structure of a recording head, which is incorporated to the present invention. This structure includes heating portions disposed on bent portions in addition to a combination of the ejection orifices, liquid passages and the electrothermal transducers disclosed in the above patents. Moreover, the present invention can be applied to structures disclosed in Japanese Patent Application Laying-open Nos. 123670/1984 and 138461/1984 in order to achieve similar effects. The former discloses a structure in which a slit common to all the electrothermal transducers is used as ejection orifices of the electrothermal transducers, and the latter discloses a structure in which openings for absorbing pressure waves caused by thermal energy are formed corresponding to the ejection orifices Thus, irrespective of the type of the recording head, the present invention can achieve recording positively and effectively.

In addition, the present invention can be applied to various serial type recording heads: a recording head fixed to the main assembly of a recording apparatus; a conveniently replaceable chip type recording head which, when loaded on the main assembly of a recording apparatus, is electrically connected to the main assembly, and is supplied with ink therefrom; and a cartridge type recording head integrally including an ink reservoir.

It is further preferable to add a recovery system, or a preliminary auxiliary system for a recording head as a constituent of the recording apparatus because they serve to make the effect of the present invention more reliable. As examples of the recovery system, are a capping means and a cleaning means for the recording head, and a pressure or suction means for the recording head. As examples of the preliminary auxiliary system, are a preliminary heating means utilizing electrothermal transducers or a combination of other heater elements and the electrothermal transducers, and a means for carrying out preliminary ejection of ink independently of the ejection for recording. These systems are effective for reliable recording.

The number and type of recording heads to be mounted on a recording apparatus can be also changed. For example, only one recording head corresponding to a single color ink, or a plurality of recording heads corresponding to a plurality of inks different in color or concentration can be used. In other words, the present invention can be effectively applied to an apparatus having at least one of the monochromatic, multi-color and full-color modes. Here, the monochromatic mode performs recording by using only one major color such as black. The multi-color mode carries out recording by using different color inks, and the full-color mode performs recording by color mixing.

Furthermore, although the above-described embodiments use liquid ink, inks that are liquid when the recording signal is applied can be used: for example, inks can be employed that solidify at a temperature lower than the room temperature and are softened or liquefied in the room temperature. This is because in the ink jet system, the ink is generally temperature adjusted in a range of 30° C.–70° C. so that the viscosity of the ink is maintained at such a value that the ink can be ejected reliably.

In addition, the present invention can be applied to such apparatus where the ink is liquefied just before the ejection by the thermal energy as follows so that the ink is expelled from the orifices in the liquid state, and then begins to solidify on hitting the recording medium, thereby preventing the ink evaporation. The ink is transformed from solid to liquid state by positively utilizing the thermal energy which would otherwise cause the temperature rise; or the ink, which is dry when left in air, is liquefied in response to the thermal energy of the recording signal. In such cases, the ink may be retained in recesses or through holes formed in a porous sheet as liquid or solid substances so that the ink faces the electrothermal transducers as described in Japanese Patent Application Laying-open Nos. 56847/1979 or 71260/1985. The present invention is most effective when it uses the film boiling phenomenon to expel the ink.

Furthermore, the ink jet recording apparatus of the present invention can be employed not only as an image output terminal of an information processing device such as a computer, but also as an output device of a copying machine including a reader, and as an output device of a facsimile apparatus having a transmission and receiving function.

The present invention has been described in detail with respect to various embodiments, and it will now be apparent from the foregoing to those skilled in the art that changes and modifications may be made without departing from the invention in its broader aspects, and it is the intention, therefore, in the appended claims to cover all such changes and modifications as fall within the true spirit of the invention.

What is claimed is:

1. A bidirectional ink-jet printing apparatus employing a printing head arranged so as to oppose a printing surface on a printing medium, wherein the print head moves across the printing medium in a forward direction and a reverse direction, and having an ink ejecting portion ejecting an ink droplet group including individual ink droplets supplied from an ink storage section in accordance with printing data, comprising:

a control portion controlling a depositing area of each pixel, formed by ink droplets reaching the printing surface, by varying a number of times ink droplets are ejected from the ink ejecting portion of the printing head, as it reciprocates in a substantially parallel manner with respect to the printing surface, at least once during the movement of the print head in one of either the forward direction or the reverse direction.

2. A bidirectional ink-jet printing apparatus as claimed in claim 1, wherein flying characteristics of the ink droplet from the ink ejecting portions of said printing head are that a relative flying direction of a satellite droplet relative to a main droplet is opposite to the moving direction of said printing head.

3. A bidirectional ink-jet printing apparatus as claimed in claim 1, wherein said printing head ejects the ink droplet by heat.

4. A bidirectional ink-jet printing apparatus comprising:

a printing head transporting drive section for moving a printing head which is arranged so as to oppose a printing surface on a printing medium, wherein the print head moves across the printing medium in a forward direction and a reverse direction, and includes an ink ejecting portion for ejecting ink droplets supplied from an ink storage section, in accordance with printing data, toward the printing surface, said printing head transporting drive section reciprocally driving said ink ejecting portion in a manner substantially parallel with the printing surface of the printing medium;

a moving direction detecting section for detecting a moving direction of said printing head driven by said printing head transporting drive section, and outputting a detection result;

a drive pulse signal forming section forming a drive pulse control signal in accordance with printing control data formed on the basis of the printing data received from a printing signal processing section, and supplying the drive pulse control signal to said ink ejecting portion in said printing head in order to selectively drive said ink ejecting portion in said printing head; and an operation control section for operating said drive pulse signal forming section to make a depositing area of each pixel formed by an ink droplet reaching the printing surface uniform, based on the moving direction of said printing head represented by the detection result output from said moving direction detecting section and predetermined flying characteristics of ink droplets from said ink ejecting portion of said printing head, by varying the number of ink droplets ejected per pixel by said ink election portion during the movement of the print head in one of either the forward direction or the reverse direction.

5. A bidirectional ink-jet printing apparatus as claimed in claim 4, wherein said operation control section is responsive to printing data corresponding to an image formed by ink droplets reaching the printing surface in a discontinuous manner in the moving direction of said printing head, so as to cause said drive pulse signal forming section to vary the number of times droplets are ejected per one pixel formed by the ink droplet reaching the printing surface.

6. A bidirectional ink-jet printing apparatus as claimed in claim 4, wherein said operation control section is responsive to the printing data varying the density of the pixel formed by the ink droplet reaching the printing surface along the moving direction of said printing head, to cause an operation in said drive pulse signal forming section for varying the number of times ink droplets are ejected per one pixel formed by the ink droplet reaching the printing surface.

7. A bidirectional ink-jet printing apparatus as claimed in claim 4, wherein as said printing head moves in a first direction a part of an ink droplet ejected from said ink ejecting portion flies in a direction opposite to the moving direction of said printing head, and said operation control section operates said drive pulse signal forming section to perform ejection of ink droplets twice per one pixel when the moving direction of said printing head is in the first direction and to perform ejection of ink droplets one time per one pixel when the moving direction of said printing head is in a different direction.

8. A bidirectional ink-jet printing apparatus as claimed in claim 7, wherein said operation control section operates said drive pulse signal forming section to perform a second ejection of an ink droplet of the droplets ejected twice per one pixel before a meniscus of the ink droplet returns to an initial state existing before a first ejection of an ink droplet, after the first ejection of the ink droplet.

9. A bidirectional ink-jet printing apparatus as claimed in claim 7, wherein the depositing area of a pixel component forming element formed by the ink droplet in a second ejection, of the ink droplets ejected twice per one pixel, reaching the printing surface of said printing medium, is smaller than a depositing area of a pixel component forming element formed by the ink droplet ejected at a first ejection of the ink droplets ejected twice per one pixel.

10. An ink-jet printing apparatus as claimed in claim 9, wherein a pulse width of the drive pulse control signal formed by said drive pulse signal forming section corresponding to the second ejection of the ink droplet is smaller than the pulse width corresponding to the first ejection of the ink droplet.

11. A bidirectional ink-jet printing method employing a printing head arranged so as to oppose a printing surface on a printing medium and having an ink ejecting portion ejecting an ink droplet group including individual ink droplets supplied from an ink storage section in accordance with printing data, comprising:

driving the printing head reciprocally with respect to the printing surface in a first direction, and ejecting ink droplets from the ink ejecting portion a predetermined number of times while said printing head is driven to move in the first direction;

driving the printing head in a second direction, and ejecting ink droplets from the ink ejecting portion while the printing head is driven in the second direction; and varying a depositing area of each pixel formed by the ink droplet reaching the printing surface by varying a number of times ink droplets are ejected from the ink ejecting portion of the printing head at least once during the movement of the print head in one of either the first direction or the second direction.

12. A bidirectional ink-jet printing method as claimed in claim 11, further comprising the step of varying the number of times of ejection of the ink droplet per one unit pixel formed by the ink droplet reaching the printing surface in accordance with a moving direction of the printing head and predetermined flying characteristics of the ink droplet from the ink ejecting portion of the printing head.

13. A bidirectional ink-jet printing method as claimed in claim 12, wherein the flying characteristics of the ink droplet from the ink ejecting portion of the printing head are that a relative flying direction of a satellite droplet relative to a main droplet is in a direction opposite to the moving direction of the printing head.

14. A bidirectional ink-jet printing method as claimed in claim 11, further comprising the step of varying the number of times ink droplets are rejected per one pixel formed by the ink droplet when printing data corresponding to an image formed by ink droplets reaching the printing surface is discontinuous in the moving direction of the printing head, in accordance with the moving direction of the printing head and predetermined flying characteristics of the ink droplets from the ink ejecting portion of the printing head.

15. A bidirectional ink-jet printing method as claimed in claim 11, further comprising the step of varying the number of times ink droplets are ejected per one pixel formed by the ink droplets reaching the printing surface when the printing data corresponds to the density of the pixel formed by the ink droplets reaching the printing surface along the moving direction of the printing head.

16. A bidirectional ink-jet printing method as claimed in claim 11, wherein when the moving direction of the printing head is in a first direction and a part of the ink droplet ejected from the ink ejecting portion flies in a direction opposite to the moving direction of the printing head, the number of times of ejection of an ink droplet per one pixel when the moving direction of the printing head in the first direction is twice that of the number of times of ejection of ink droplet per one pixel when the moving direction of the printing head is in the second direction.

17. A bidirectional ink-jet printing method as claimed in claim 16, wherein the depositing area of a pixel component forming element formed by the ink droplet in a second ejection of one pixel reaching the printing surface of said printing medium, is smaller than the depositing area of a pixel component forming element formed by the ink droplet at first ejection of the one pixel.

18. A bidirectional ink-jet printing method as claimed in claim 17, further comprising the step of controlling the ejections with control signals, wherein a pulse width of a control signal formed corresponding to the second ejection is smaller than the pulse width corresponding to the first ejection.

19. A bidirectional ink-jet printing method as claimed in claim 11, wherein as the printing head moves in the first direction, a second ejection of an ink droplet is executed after a first ejection of an ink droplet and before a meniscus of the ink droplet returns to an initial state of the meniscus existing before the first ejection.

20. A bidirectional ink-jet printing method as claimed in claim 11, further comprising the step of ejecting the ink droplet from the printing head by heat.

21. A bidirectional ink-jet printing apparatus employing a printing head arranged opposing a printing surface on a printing medium, wherein the print head moves across the printing medium in a forward direction and a reverse direction, and having an ink ejecting portion ejecting an ink droplet group including individual ink droplets supplied from an ink storage section in accordance with printing data, comprising:

a control portion controlling ejection of ink onto a depositing area of at least one pixel formed by ejected ink droplets deposited on the printing surface, said control portion controlling ejection of ink by varying a number of times ink droplets are ejected from the ink ejecting portion of the printing head, as the printing head reciprocates in a substantially parallel manner with respect to the printing surface, at least once during the movement of the print head in one of either the forward direction or the reverse direction, wherein a depositing area of a pixel element formed by the second of two ink droplet ejections is smaller than a depositing area of a pixel element formed by the first of the two ink droplet ejections.

* * * * *

UNITED STATES PATENT AND TRADEMARK OFFICE

CERTIFICATE OF CORRECTION

PATENT NO. : 6,126,262
DATED : October 3, 2000
INVENTOR(S) : Yoshinori Misumi

It is certified that error appears in the above-identified patent and that said Letters Patent is hereby corrected as shown below:

Column 1,
Line 34, "-head" should read -- head --; and
Line 51, "makes" should read -- which makes --.

Column 2,
Line 20, "the of" should read -- the direction of --; and
Line 61, "reverse." should read -- reverse direction. --.

Column 5,
Line 41, "example.." should read -- example. --.

Column 7,
Line 43, "supplied," should read -- supplied with --; and
Line 57, "maintain" should read -- maintains a --.

Column 8,
Line 25, "supplied" should read -- supplied with --;
Line 37, "maintain" should read -- maintains --;
Line 40, "ta," should read -- $t_a$, --;
Line 41, "tb," should read -- $t_b$, --; and
Line 42, "conclude." should read -- concludes. --.

Column 9,
Line 18, "pattern Even" should read -- pattern. ¶Even --;
Line 53, "group" should read -- groups --;
Line 62, "non-continuos." should read -- non-continuous. --; and
Line 65, "continues." should read -- continuous. --.

Column 10,
Line 20, "with by" should read -- by --; and
Line 44, "is" should read -- are --.

Column 11,
Line 18, "orifices" should read -- orifices. --; and
Line 56, "used:" should read -- used, --.

UNITED STATES PATENT AND TRADEMARK OFFICE

CERTIFICATE OF CORRECTION

PATENT NO. : 6,126,262
DATED : October 3, 2000
INVENTOR(S) : Yoshinori Misumi

It is certified that error appears in the above-identified patent and that said Letters Patent is hereby corrected as shown below:

Column 13,
Line 18, "election" should read -- ejection --; and
Line 62, "An" should read -- A bidirectional --.

Signed and Sealed this

Twenty-ninth Day of January, 2002

*Attest:*

*Attesting Officer*

JAMES E. ROGAN
*Director of the United States Patent and Trademark Office*